United States Patent [19]

Lukianoff

[11] Patent Number: 4,640,060

[45] **Date of Patent: * Feb. 3, 1987**

[54] HAND HELD SANDING DEVICE

[76] Inventor: Sergei G. Lukianoff, 2107 Van Ness Ave., San Francisco, Calif. 94109

[ * ] Notice: The portion of the term of this patent subsequent to Feb. 26, 2002 has been disclaimed.

[21] Appl. No.: 705,505

[22] Filed: Feb. 25, 1985

Related U.S. Application Data

[63] Continuation-in-part of Ser. No. 454,608, Dec. 30, 1982, Pat. No. 4,501,096.

[51] Int. Cl.[4] ..... B24B 29/02

[52] U.S. Cl. ..... 51/391; 51/371; 51/358

[58] Field of Search ..... 51/391, 371, 370, 381, 51/358

[56] References Cited

U.S. PATENT DOCUMENTS 3,918,220 11/1975 Jury et al. ..... 51/328

4,501,096 2/1985 Lukianoff ..... 51/391

FOREIGN PATENT DOCUMENTS 122642 10/1927 Switzerland ..... 51/189

*Primary Examiner*—Frederick R. Schmidt

*Assistant Examiner*—Maurina Rachuba

[57] ABSTRACT

An improved hand held sanding device includes a resilient block having laterally extending intersecting faces which form block perimeters surfaces around which an abrasive material can be wrapped. The perimeter surfaces include a bottom and side surface, and a top surface extending in a convex curvature from the bottom surface to the top surface; the convex top surface has a receiving slot of a width to snuggly receive two ends of abrasive sheet material tightly wrapped around the block perimeter surface. In accordance with the invention at least one of the bottom or side surfaces is additionally contoured for used on sanding surfaces with special contours.

6 Claims, 8 Drawing Figures

HAND HELD SANDING DEVICE

CROSS-REFERENCES TO RELATED APPLICATIONS

This is a continuation-in-part of application Ser. No. 454,608 filed Dec. 30, 1982 now U.S. Pat. No. 4,501,096.

BACKGROUND OF THE INVENTION

The present invention generally relates to the field of hand tools, and more particularly relates to hand-sanding devices used to hold sandpaper and to provide a working grip for sanding.

Small sanding jobs and sanding jobs calling for considerable detail work or access to small confined areas will usually call for the direct hand application of sandpaper of one or more suitable grit sizes. The difficulty in hand-sanding is in applying firm pressure long enough to complete the job and in applying even pressure to obtain a desired smooth and even finish. A further difficulty is to obtain efficient use of the sandpaper by not wasting any substantial portion of its surface area.

To facilitate hand-sanding square sanding blocks, sized to fit the hand, have been used for years. By using a sanding block as a sandpaper holder, hand-applied sanding forces can be increased and more evenly distributed. However, one of the problems encountered in typically make-shift square sanding blocks is the tendency of the sandpaper to rip off the block when in use. Another problem is that the block dimensions limit the ability of the sander to sand curved surfaces and get into hard to access corners and other locations, such as frequently found around window sills and door jams. Block sandpaper holders are also generally made of scrap wood material with a hard nonresilient surface, frequently causing the sander to overly cut or gouge the sanded surface. Still another problem is to evenly sand convex surfaces such as a banister rail with flat block surfaces without scoring the wood, and to sand shaped wood surfaces such as molding surfaces.

The present invention is a hand-held sanding device for use with sandpaper or other abrasive sheet material which overcomes the above limitations of conventional block sandpaper holders by providing a device around which a sheet of sandpaper can be wrapped and easily secured. The invention actively holds the sandpaper around the device during any sanding operation without mechanical attachments such as staples, tacks, nails, or the like. The hand-held sanding device of the invention renders useable practically the entire sandpaper surface and, in addition, provides three different surface configurations, including, in particular, the improvement of providing, in combination with the above, a special purpose sanding surface as described below.

SUMMARY OF THE INVENTION

The hand-held sanding device of the invention is generally comprised of a resilient block having three laterally extending intersecting faces which form a block perimeter surface about which sandpaper material can be wrapped. At the two lateral ends of the block there are two additional cross-cut surfaces. The three intersecting block faces supporting the sandpaper is comprised of a bottom and top surface, at least one of which is given a special purpose contour, such as, for example, a slight concave curvature for sanding rounded surfaces or a shaped surface which conforms in shape to standard molding. The third perimeter surface is a curved surface extending in a single convex curve from the bottom surface upwardly to the top surface. It will be seen that these three intersecting surfaces provide a generally triangular and uniform cross-sectional shape to the block, that the intersection of the three working surfaces provide three laterally extending block corners of different angles. In combination therewith the block will have a special purpose working surface for specialized sanding jobs.

In accordance with the invention the block's top curved surface has a receiving slot intermediate and substantially parallel to the laterally extending corners of the block which bound this curved surface, with the receiving slot having a width to snuggly receive the two ends of a sandpaper material when the sandpaper is tightly wrapped around the block perimeter surface: thusly is the sandpaper held on the block. It is contemplated that, by using a resilient deformable block material, the pressures on the block surfaces created by sanding will cause the receiving slot to deform to tightly grip the inserted sandpaper ends. Also, by providing a second shaped surface, such as a concave surface, instead of two additional flat surfaces, two raised lateral block edges are produced across which the sandpaper can be tautly drawn, creating more effective folding forces between the paper and the block.

Therefore, it is seen that the primary object of the present invention is to provide a hand-held sanding device that self-grips the sandpaper, that provides suitable holding pressure against the sandpaper ends to prevent the sandpaper ends from tearing away during any sanding operation, and that at the same time maximizes the gripping action of the block to prevent movement of the sandpaper thereon.

It is a further object of the present invention to provide a hand-held sanding device having three differently dimensioned sanding surfaces, including one slotted convex surface and further including one specially shaped surface for handling different sanding operations including certain specialized sanding jobs.

It is another object of the invention to provide an improved sanding device that is capable of holding most types of sandpaper, including wet and dry sandpaper, or emery cloth, that has the overall resiliency to ride over surface irregularities without damaging the surface, and that can hold sandpaper on the device without the aid of mechanical attachments.

Yet further objects of the invention will become apparent from the following specifications and claims.

DETAILED DESCRIPTION OF THE PREFERRED EMBODIMENT

Figure 1:
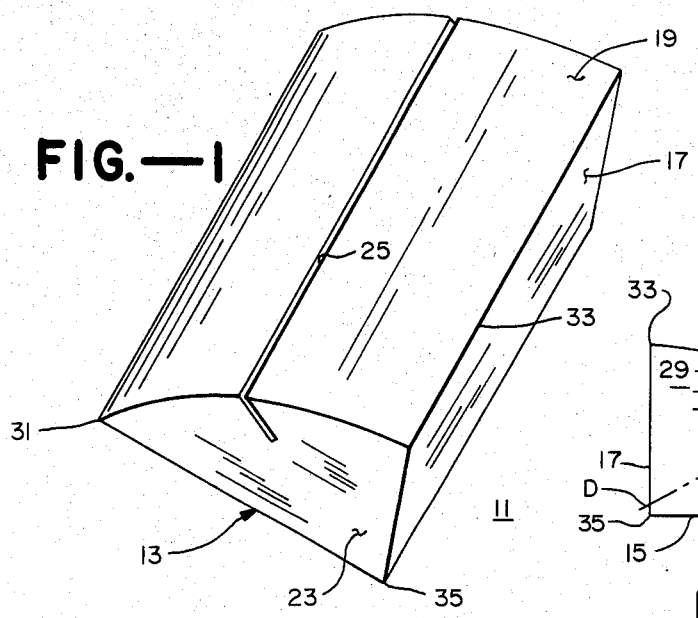
FIG. 1 of the drawings is an isometric view of a hand-held sanding device generally in accordance with the invention, but without a special purpose working surface.

Referring now to the drawings, the block sander of the invention is generally denoted in FIG. 1 by the numeral 11. A block 13 having a uniform, generally triangular cross-sectional shape is fabricated of a resilient, deformable material which will tend to deform against rough and raised surface areas, thereby sanding these areas without damaging the surface; as will be discussed below, the deformable material will also enhance the block's ability to hold the sandpaper to the block. One suitable material from which the block can be fabricated is 3 to 4½ lb. polystyrene. However, it has been found that polyurethane foam under 2 to 6 lb. pressure is the most suitable resilient material for fulfilling the objects of the invention. It is understood, however, that the invention is not limited to the materials and material grades above described.

Figure 6:
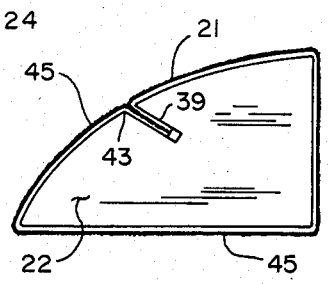
FIG. 6 is an end elevation view of the hand-held sanding device illustrated in the previous figures showing a sheet of sandpaper secured thereto.

It is seen that block 33 has three intersecting faces 15, 17, 19 which form a block perimeter surface about which a sheet of sandpaper or other abrasive sheet material can be wrapped, such as the sandpaper 21 shown wrapped around the block 22 shown in FIG. 6; the other two faces of the block are the two end surfaces 23, 24 which define the length of the block and which are preferably perpendicular cross cuts. It is seen that, with its uniform cross-sectional shape, the block can be fabricated in long lengths which, in the fabricating process, can be cut into a number of smaller usable lengths.

Figure 2:
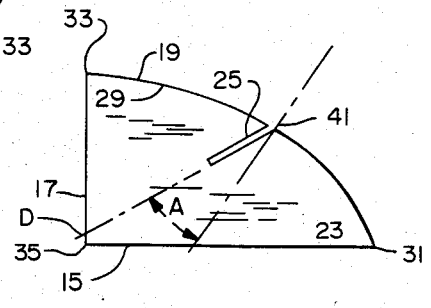
FIG. 2 is an end elevation view thereof.
Figure 3:
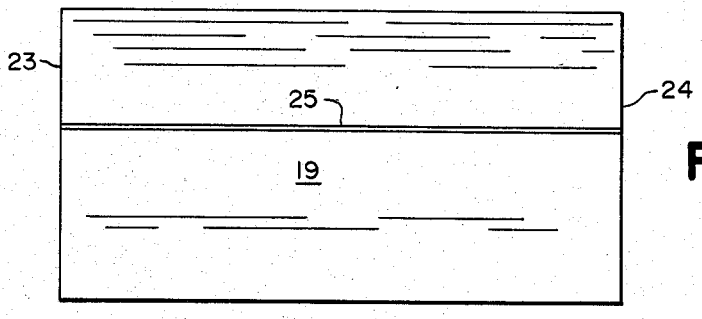
FIG. 3 is a top plan view thereof.
Figure 4:
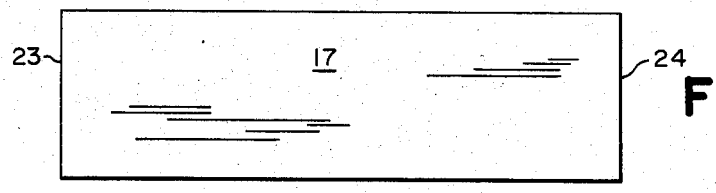
FIG. 4 is a side elevation view thereof taken from the right side of FIG. 1.
Figure 5:
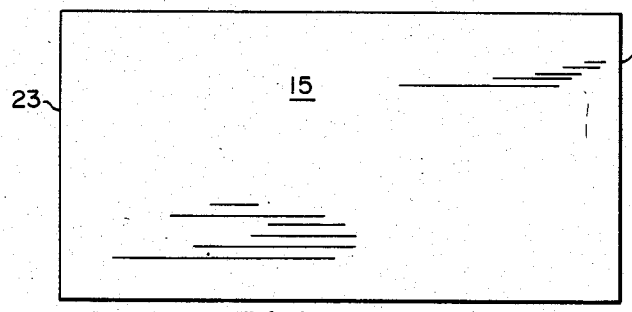
FIG. 5 is a bottom plan view thereof.

FIG. 2 best illustrates the basic embodiment of the invention covered in applicant's co-pending Serial No. 454,600 and which is improved upon as hereinafter described. The three block faces 15, 17, 19, which form 360 degrees of perimeter surface, include one substantially flat bottom surface 15 and one substantially flat side surface 17 perpendicular to the bottom surface, with the side surface having a smaller width than the bottom surface. The other face is the top surface 19 which extends in a single convex curve about the lengthwise axis of the block from the bottom surface 15 upwardly to the side surface 17. The top surface 19 is bisected by the receiving slot 25 which laterally extends the full length of the block. The curvature of the lower portion 27 of the curved surface 19 (that portion generally below the receiving slot 25) is generally steeper, that is it has a smaller radius of curvature, than the curved surface's top portion 29 which is more gradual. This provides a sanding surface with a continuously varying curvature as well as block corners 31, 33 having different angles.

It has been discovered that certain dimensions for the above-described block surfaces are uniquely adapted to handle a variety of sanding chores as described in the foregoing discussion of the background of the invention. In the preferred embodiment the block will have the following approximate overall dimensions: the width of the bottom surface 15 will be approximately 2¾ inches while the height of the side surface 17 will be approximately 1¾ inches; and the curved top surface will measure approximately 3¼ inches along its curve from the side surface to the bottom surface. The radius of the top portion 29 of the curve above the receiving slot 25 will be approximately 5¼ inches and the radius of the steeper, lower portion 27 of the curve will be approximately two inches. The length of the block is less critical, however, it is found that a convenient length which easily fits into the hand is approximately 5½ inches. It is understood that the invention is not limited to the above dimensions and that within the spirit of the invention the dimensions can be scaled up or down, or varied somewhat while still achieving the objects of the invention.

From the foregoing and from FIG. 2 of the drawings, it is seen that the three corners 31, 33, 35 of the block will, and should have, angles of approximately 45 degrees, 60 degrees, and 90 degrees, respectively. By providing three different angles, a variety of different sanding requirements can be accommodated.

The position and orientation of the block's receiving slot 25 will contribute to the gripping power of the receiving slot in holding the edges 39 of the sandpaper 21. Preferably, the receiving slot is angled back toward the side surface 17 in reference to a normal plane perpendicular to top surface 19. The reference plane is represented by the center line 41 in FIG. 2, and the plane of the slot is represented by the numeral 42. It is found that the slot, for the best gripping action and to reduce the possibility of splitting, should be positioned on the curve surface such that the slot plane 42 intersects the side wall 17 approximately ¼ inch to ½ inch from the bottom surface 15. This distance is represented by the letter "D" in FIG. 2 and is based on the overall preferred dimensions for the block as discussed below, which dimensions are scalable. The degree of angulation, A, between the receiving slot and the normal plane 41 will be approximately 30 degrees for a centrally located slot. It is found that, with the deformable material of the block in which the receiving slot is cut, the receiving slot will be compressed closed to tightly grip the sandpaper no matter where pressure is applied to the block's perimeter surfaces 15, 17, 19. For example, if the lower portion 27 of the top curved surface 19 is used for sanding, the normal force against the block at this point together with the co-acting force of the hand gripping the block's bottom surface 15 and side surface 17 will force the receiving slot closed. Likewise, the receiving slot will be forced closed while sanding with the bottom or side surfaces 15, 17 while gripping the top curved surface 19. In all sanding positions, the top of the receiving slot 43 tends to pinch the folded over tips of the sandpaper 39. It is noted that if the slot were cut perpendicular to the curved surface 19 along the normal plane 41, sanding along the top curved surface in the vicinity of the slot may tend to spread the slot and loosen its grip on the sandpaper; conversely if the slot is angled substantially toward the curved surface, the fold over of the lower edge 45 of the sandpaper will be very slightly and this edge may tend to side out relativey easily where no pressure or relatively slight pressure is placed on the block.

As to the dimensions of the receiving slot, it has been found that a slot depth of approximately three quarters of an inch is suitable, and that the slot should have a width of approximately 1/16 of an inch. On the top curved surface, the slot is placed intermediate to the two corners 30 and 33 approximately two inches down on the curved surface from the top corner 33. It is found, and is believed that in terms of achieving the objects of the invention of securely and releasably holding the sandpaper, that the most critical of the slot dimensions is the slot width. The placement of the slot on the curved surface may vary somewhat, however, it is desirable to have it close to the center point on the curved surface, and to preferably have it in the position above-described.

Figure 7:
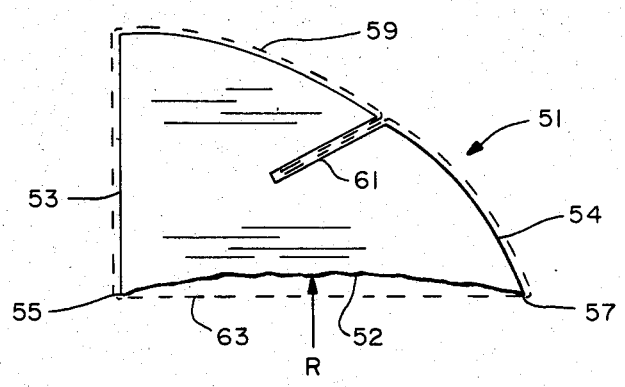
FIGS. 7 and 8 are end elevation views of the improved hand-held sanding device of the invention, showing contours on the bottom surface thereof.
Figure 8:
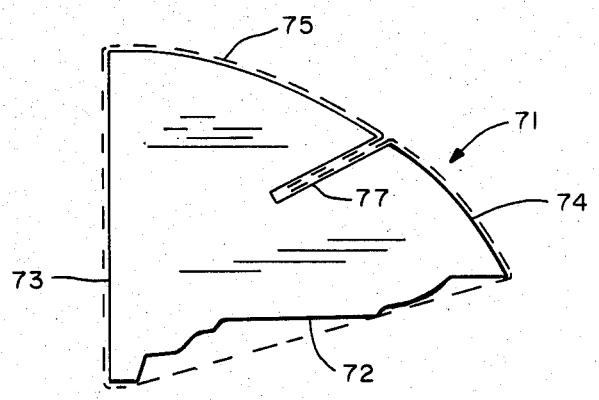

Referring now to FIG. 7 and 8 and the therein illustrated improvements to the basic block design above-described, it can be seen that in accordance with the improvement at least one of the top or bottom surfaces is provided with a desired contour to adapt the block for specialized sanding jobs. In FIG. 7 it is seen that the bottom surface 52 of block 51 is given a slightly concave shape whereby the surface extends in a continuous concave curvature from the block's rear corner 55 formed by intersecting side and bottom surfaces 52, 53 and the block's front corner 57 formed by intersection of the top convex surface 54 with bottom surface 52. It can further be seen that the concave curvature of bottom surface 52 produces a more knife-like edge to these two corners of the block than would occur if the bottom surface 52 were absolutely flat as illustrated in FIG. 2.

The concave surface 52 of the FIG. 7 embodiment will reduce the problem of scoring or unevenly taking down surfaces having a rounded configuration, such as, for example, a banister rail. A sheet of sandpaper 59 drawn tightly around the block and secured in slot 61 as above-described in respect to the basic FIG. 2 configuration, will be stretched across the bottom surface between the opposed block corners 55, 57. The paper 59 retains enough play on the block that the length of paper 63 spanning the bottom surface 52 will be forced against the concavity when pressure is applied at this surface. The concavity provides an additional advantage over the basic configuration of FIG. 2, in that, the more knife-like corners 55, 57 will likely provide greater gripping power to the paper 59 and preventing same from slipping on the block to a greater degree than with the FIG. 2 design.

The radius, R, of the concave surface 52 of the FIG. 7 block should generally be slight since all that is needed to achieve the objects of the invention is a sanding surface having a slight curvature in comparison to the curvature to be sanded. Too great a curvature would decrease the overall utility of this surface. Generally, curvatures having radiuses of between approximately 8 inches and 14 inches would provide a suitable surface for most applications where a curved sanding surface is desirdable.

It is noted that while the concave surface is shown as the bottom surface of the sanding block 51, it would be possible to place this surface on the shorter side surface 53, or possibly on both bottom and side surfaces 52, 53. However, the general overall utility of the block is greatest if at least one flat surface is provided in addition to a concave and convex surface.

With reference to FIG. 8, it is seen that the bottom surface 72 (or alternatively the side surface 73) of the block 71 can be provided with shapes other than a uniformly concave surface as shown in FIG. 7. Such shapes would include the illustrated molding shape given to bottom surface 72 of the FIG. 8 embodiment. This illustrated molding shape is typical of many common and widely available prefabricated molding shapes. As illustrated, the sandpaper 75, which is wrapped around the block 71 and which has its ends secured in the slot 77, stretches across the molded surface 72 in much the same manner that the sandpaper 59 stretches across the concave surface 52 of the FIG. 7 block. When the block's molded surface 72 is placed against a corresponding molding piece and pressure is applied, the play of the sandpaper on the block will permit the paper to take the shape of this molded surface. Being tightly wrapped about the block and having its ends securely compressed within slot 77, the paper will be securely held on the block with little possibility of slippage.

It will readily be understood that one of the two side and bottom surfaces of the generally triangular shaped block of the invention can be given shapes other than those illustrated in the drawings to meet a variety of specialized sanding needs. For example, one of the surfaces could be given a stepped shape to generally conform to the offset planking configuration found in ship building; or it might be provided with specialized curves found in automotice body designs. The variety of possible customized shapes is endless.

Therefore, it is seen that the present invention is a hand-held sanding device capable of securely and releasably holding a piece of sandpaper or other abrasive sheet material around its perimeter by means of a suitable constructed receiving slot 25 located along the curved surface of the block's three sanding surfaces, 15, 17, 19. The receiving slot is located and positioned so that sanding forces will actually increase the gripping power of the slot and prevent the ends of the sandpaper from slipping out. It is also seen that the invention provides a hand-held sanding device with a variety of different sanding surfaces and corners to handle a variety of different sanding chores in a single hand-held, light weight, and durable device, and that it particularly provides, in such a device, at least one special purpose sanding surface.

While the present invention has been described in considerable detail in the foregoing specification, it is not intended that such detail limit the scope of the invention. It is rather intended that the scope of the invention be defined by the claims which are as follows.

What I claim is:

1. An improved hand-held sanding device for use with sandpaper or other abrasive sheet material comprising a resilient block having laterally extending intersecting faces forming block perimeter surfaces about which said abrasive material can be wrapped, said perimeter surfaces comprising a bottom and side surface, and a top surface extending in a convex curvature from said bottom surface upwardly to said side surface, the intersection of said top, bottom and side surfaces forming three laterally extending block edges, at least one of said bottom or side surfaces having a contour adapted to a specialized sanding surface, and said convex top surface having a receiving slot formed therein intermediate and substantially parallel to the laterally extending edges of said curved top surface, said receiving slot being of a width to snuggly receive two ends of abrasive sheet material tightly wrapped around the block perimeter surface to hold same in its tightly wrapped position.

2. The improved hand-held sanding device of claim 1 wherein said contoured surface is a concave surface having a relatively large radius of curvature.

3. The improved hand-held sanding device of claim 2 wherein the radius of curvature of said contoured surface is between approximately eight inches and fourteen inches.

4. The improved hand-held sanding device of claim 3 wherein said contoured surface has a width defined as the distance between the two of said laterally extending block edges bounding said contoured surface, and wherein the width of said contoured surface is approximately 2 to 3½ inches.

5. The improved hand-held sanding device of claim 3 wherein the width of said contoured surface is approximately $2\frac{3}{4}$ inches.

6. The improved hand-held sanding device of claim 1 wherein said contoured surface corresponds in shape to a standard molding strip surface whereby the sandpaper overlaying the contoured surface of said device can be laid over and under hand pressure made to conform to the contoured surfaces of said molding strip.

* * * * *